US011898299B2

(12) United States Patent
Nam et al.

(10) Patent No.: US 11,898,299 B2
(45) **Date of Patent: *Feb. 13, 2024**

(54) LAUNDRY TREATING APPARATUS

(71) Applicant: LG Electronics Inc., Seoul (KR)

(72) Inventors: Wansik Nam, Seoul (KR); Donghyun Kim, Seoul (KR); Jumin Park, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/561,179

(22) Filed: Dec. 23, 2021

(65) Prior Publication Data

US 2022/0112652 A1 Apr. 14, 2022

Related U.S. Application Data

(63) Continuation of application No. 16/411,658, filed on May 14, 2019, now Pat. No. 11,225,752, which is a (Continued)

(30) Foreign Application Priority Data

May 16, 2016 (KR) ..... 10-2016-0059713

(51) Int. Cl.
*F26B 5/00* (2006.01)
*F26B 7/00* (2006.01)

(Continued)

(52) U.S. Cl.
CPC ..... *D06F 58/10* (2013.01); *A47B 61/00* (2013.01); *B65D 85/18* (2013.01); *D06F 58/20* (2013.01);

(Continued)

(58) Field of Classification Search
CPC ..... D06F 58/10; D06F 58/20; D06F 2103/50; F26B 3/04; F26B 3/06; F26B 25/06

(Continued)

(56) References Cited

U.S. PATENT DOCUMENTS 5,711,159 A * 1/1998 Whipple, III ..... F25D 29/00 62/82
6,154,924 A * 12/2000 Woo ..... E05F 3/14 16/65

(Continued)

FOREIGN PATENT DOCUMENTS

CN 2195562 Y 4/1995
CN 1102993 C 3/2003

(Continued)

*Primary Examiner* — Ko-Wei Lin
(74) *Attorney, Agent, or Firm* — BRYAN CAVE LEIGHTON PAISNER LLP

(57) ABSTRACT

A laundry treating apparatus is disclosed. The laundry treating apparatus includes a cabinet configured to define a receiving space for receiving laundry, the cabinet having an open surface, a door hingedly provided at the cabinet for opening and closing the open surface of the cabinet, a laundry support unit provided in the receiving space for supporting laundry, and a machinery compartment provided in the cabinet for defining a space that is separate from the receiving space, the machinery compartment being provided therein with an air supply unit for dehumidifying or heating air in the receiving space and supplying the dehumidified or heated air into the receiving space. The air supply unit dehumidifies air in a room that communicates with the receiving space in the state in which the door is open.

20 Claims, 11 Drawing Sheets

Related U.S. Application Data continuation of application No. 15/595,390, filed on May 15, 2017, now Pat. No. 10,329,081.

(51) Int. Cl.

| | |
|---|---|
| ***D06F 58/10*** | (2006.01) |
| ***D06F 58/20*** | (2006.01) |
| ***D06F 73/02*** | (2006.01) |
| ***A47B 61/00*** | (2006.01) |
| ***B65D 85/18*** | (2006.01) |
| ***F24F 13/06*** | (2006.01) |
| ***F24F 13/20*** | (2006.01) |
| ***F24F 13/30*** | (2006.01) |
| *D06F 58/30* | (2020.01) |
| *D06F 103/50* | (2020.01) |
| *D06F 105/26* | (2020.01) |

(52) U.S. Cl.

CPC ..... *D06F 73/02* (2013.01); *F24F 13/0604* (2013.01); *F24F 13/20* (2013.01); *F24F 13/30* (2013.01); *D06F 58/206* (2013.01); *D06F 58/30* (2020.02); *D06F 2103/50* (2020.02); *D06F 2105/26* (2020.02); *F24F 2013/207* (2013.01)

(58) Field of Classification Search

USPC ..... 34/282, 427

See application file for complete search history.

(56) References Cited

U.S. PATENT DOCUMENTS

| | | | | |
|---|---|---|---|---|
| 7,040,039 | B1 * | 5/2006 | Stein | D06F 58/22 34/529 |
| 7,926,201 | B2 * | 4/2011 | Kim | D06F 34/20 15/300.1 |
| 9,625,160 | B2 * | 4/2017 | Xiao | E05F 1/1041 |
| 10,041,203 | B2 * | 8/2018 | Ahn | D06F 58/38 |
| 2002/0088139 | A1 * | 7/2002 | Dinh | F26B 23/002 34/467 |
| 2008/0155994 | A1 * | 7/2008 | Miyamoto | F25D 11/02 62/6 |
| 2009/0248206 | A1 * | 10/2009 | Yoo | D06F 58/50 700/275 |
| 2010/0243767 | A1 * | 9/2010 | Mori | F25D 29/006 62/449 |
| 2011/0005097 | A1 * | 1/2011 | Moon | D06F 58/206 34/493 |
| 2011/0232304 | A1 * | 9/2011 | Bortoletto | F24F 6/00 700/282 |
| 2012/0110869 | A1 * | 5/2012 | Bellinger | D06F 58/38 34/427 |
| 2013/0290902 | A1 * | 10/2013 | Martin | G06F 3/0485 715/830 |
| 2014/0317948 | A1 * | 10/2014 | Lee | D06F 58/12 34/218 |
| 2015/0015989 | A1 * | 1/2015 | Sytine | G11B 5/105 216/22 |
| 2015/0068245 | A1 * | 3/2015 | Haikawa | F25B 1/005 62/498 |
| 2015/0147953 | A1 * | 5/2015 | Park | F24F 11/0001 454/256 |
| 2015/0159890 | A1 * | 6/2015 | Chang | F24F 3/1405 62/515 |
| 2016/0024831 | A1 * | 1/2016 | Houser | E05F 15/63 49/506 |
| 2016/0056634 | A1 * | 2/2016 | Choi | H02J 9/005 307/64 |
| 2016/0115640 | A1 * | 4/2016 | Kim | H01H 36/004 34/82 |
| 2016/0187041 | A1 * | 6/2016 | Yoshikawa | F25D 21/14 62/81 |
| 2017/0175320 | A1 * | 6/2017 | Masters | D06F 29/005 |
| 2018/0274166 | A1 * | 9/2018 | Xu | D06F 58/46 |

FOREIGN PATENT DOCUMENTS

| | | | |
|---|---|---|---|
| CN | 1478946 | A | 3/2004 |
| CN | 201254664 | Y | 6/2009 |
| CN | 102733160 | A | 10/2012 |
| CN | 104120599 | A | 10/2014 |
| CN | 104790189 | A | 7/2015 |
| CN | 105063958 | A | 11/2015 |
| CN | 105531434 | A | 4/2016 |
| EP | 2896740 | A1 | 7/2015 |
| JP | 2008104625 | A | 5/2008 |
| JP | 2009-078674 | A | 4/2009 |
| KR | 10-0182650 | B1 | 5/1999 |
| KR | 10-0202260 | B1 | 6/1999 |
| KR | 10-2014-0127503 | A | 11/2014 |
| KR | 10-2015-0085728 | A | 7/2015 |
| WO | 2014008874 | A1 | 1/2014 |

* cited by examiner

LAUNDRY TREATING APPARATUS

This application is a Continuation of U.S. patent application Ser. No. 16/411,658, filed May 14, 2019, which is a Continuation of U.S. patent application Ser. No. 15/595,390, filed on May 15, 2017, issued as U.S. Pat. No. 10,329,081, which claims priority and the benefit of Korean Patent Application No. 10-2016-0059713 filed on May 16, 2016, which is hereby incorporated by reference as if fully set forth herein.

BACKGROUND OF THE INVENTION

Field of the Invention

The present invention relates to a laundry treating apparatus, and more particularly to a laundry treating apparatus that is capable of performing indoor dehumidification.

Discussion of the Related Art

In general, a laundry treating apparatus is an apparatus that performs various operations (e.g. washing, drying, deodorization, and removal of wrinkles) related to laundry. The laundry treating apparatus includes a washer that washes laundry, a dryer that dries wet laundry, and a refresher that removes smells from laundry or removes wrinkles from laundry.

In most cases, the laundry treating apparatus is installed in a so-called dressing room, in which clothes are placed. Since a large amount of clothes are placed in the dressing room, however, the clothes may be wetted due to poor ventilation. Particularly, in the rainy season or the summer reason, in which humidity is high, the clothes may be damaged due to humidity. In order to prevent such damage due to humidity, a dehumidifier may be further used.

Providing both the laundry treating apparatus and the dehumidifier entails limitations limited in terms of space and expense.

SUMMARY OF THE INVENTION

Accordingly, the present invention is directed to a laundry treating apparatus that substantially obviates one or more problems due to limitations and disadvantages of the related art.

One object of the present invention is to provide a laundry treating apparatus that is capable of performing indoor dehumidification.

Another object of the present invention is to provide a laundry treating apparatus that generates little noise and is capable of preventing an increase in indoor temperature due to dehumidification.

Additional advantages, objects, and features will be set forth in part in the description which follows and in part will become apparent to those having ordinary skill in the art upon examination of the following or may be learned from practice. The objectives and other advantages may be realized and attained by the structure particularly pointed out in the written description and claims hereof as well as the appended drawings.

To achieve these objects and other advantages and in accordance with the purpose of the invention, as embodied and broadly described herein, in accordance with an aspect of the present invention, a laundry treating apparatus includes a cabinet configured to define a receiving space for receiving laundry, the cabinet having an open surface, a door hingedly provided at the cabinet for opening and closing the open surface of the cabinet, a laundry support unit provided in the receiving space for supporting laundry, and a machinery compartment provided in the cabinet for defining a space that is separate from the receiving space, the machinery compartment being provided therein with an air supply unit for dehumidifying or heating air in the receiving space and supplying the dehumidified or heated air into the receiving space, wherein the air supply unit dehumidifies air in a room that communicates with the receiving space in the state in which the door is open.

The temperature of air that is supplied into the room by the air supply unit in the state in which the door is open may be lower than the temperature of air that is supplied into the receiving space by the air supply unit in the state in which the door is closed.

The air supply unit may include a circulation duct provided in the machinery compartment for circulating the air in the receiving space and a heat exchanger configured to circulate refrigerant so as to constitute a refrigerating cycle, the heat exchanger being configured to dehumidify or heat air in the circulation duct through heat exchange.

The heat exchanger may include an evaporator provided in the circulation duct for dehumidifying the air introduced into the circulation duct, a condenser provided in the circulation duct for heating the air that has passed through the evaporator, and a compressor and an expansion valve provided outside the circulation duct for supplying the refrigerant to the evaporator and the condenser.

The laundry treating apparatus may further include a controller configured to control the operation of the heat exchanger.

The controller may differently control the driving frequency of the compressor and the opening degree of the expansion valve depending on whether the door is open or closed.

The controller may perform control such that the driving frequency of the compressor and the opening degree of the expansion valve in the state in which the door is open are lower than the driving frequency of the compressor and the opening degree of the expansion valve in the state in which the door is closed.

The laundry treating apparatus may further include a drainage tank for storing condensed water generated in the evaporator.

The laundry treating apparatus may further include an air suction unit provided in one surface of the machinery compartment so as to communicate with one end of the circulation duct for introducing the air in the receiving space into the circulation duct and an air discharge unit provided in one surface of the machinery compartment so as to communicate with the other end of the circulation duct for discharging the air in the circulation duct into the receiving space.

The machinery compartment may further include a moisture supply unit for supplying moisture into the receiving space.

The laundry treating apparatus may further include a moisture discharge unit provided in one surface of the machinery compartment so as to communicate with the moisture supply unit for supplying moisture generated in the moisture supply unit into the receiving space.

The moisture supply unit may include a moisture supply pipe connected to a water supply tank, a steam generator configured to generate steam from water supplied through the moisture supply pipe, and a steam supply pipe for supplying the steam generated by the steam generator into the receiving space.

The laundry support unit may be configured to reciprocate in the receiving space.

The laundry treating apparatus may further include an opening and closing sensing unit for sensing whether the door is open or closed and sensing an opening angle of the door.

The laundry treating apparatus may further include a connection member configured to connect the door and the cabinet to each other such that the door selectively opens and closes the receiving space. The connection member may support the door such that the door is maintained at a predetermined opening angle.

In accordance with another aspect of the present invention, a laundry treating apparatus includes a cabinet configured to define a receiving space for receiving laundry, the cabinet having an open surface, a door hingedly provided at the cabinet for opening and closing the open surface of the cabinet, a laundry support unit provided in the receiving space for supporting laundry, a machinery compartment provided in the cabinet for defining a space that is separate from the receiving space, the machinery compartment being provided therein with an air supply unit for dehumidifying or heating air in the receiving space and supplying the dehumidified or heated air into the receiving space, a manipulation unit including an indoor dehumidification selection unit for selecting a dehumidification mode in which air in a room communicating with the receiving space is dehumidified in the state in which the door is open such that the dehumidification mode is executed in the machinery compartment, and an opening and closing sensing unit for sensing whether the door is open or closed.

The opening and closing sensing unit may sense the opening angle of the door.

The laundry treating apparatus may further include a controller configured to determine whether the door is open or closed or the opening angle of the door through the opening and closing sensing unit when the indoor dehumidification selection unit is selected or during the execution of the dehumidification mode.

The laundry treating apparatus may further include a display unit configured to output an error message upon determining that the door is closed or the door is open to a predetermined angle or less when the indoor dehumidification selection unit is selected or during the execution of the dehumidification mode.

The error message may be at least one selected from among an information message, an icon, and a mark that indicates "open the door."

The laundry treating apparatus may further include a speaker unit. The controller may perform control such that an alarm or an information announcement is output through the speaker unit upon determining that the door is closed or the door is open to the predetermined angle or less when the indoor dehumidification selection unit is selected or during the execution of the dehumidification mode.

The information announcement may be "open the door."

The opening and closing sensing unit may include a reed switch and a permanent magnet.

The reed switch may be located at the cabinet, and the permanent magnet may be located at the door.

It is to be understood that both the foregoing general description and the following detailed description of the present invention are exemplary and explanatory and are intended to provide further explanation of the present invention as claimed.

BRIEF DESCRIPTION OF THE DRAWINGS

The accompanying drawings, which are included to provide a further understanding of the present invention and are incorporated in and constitute a part of this application, illustrate embodiment(s) of the present invention and together with the description serve to explain the principle of the present invention. In the drawings.

DETAILED DESCRIPTION OF THE INVENTION

Figure 1:
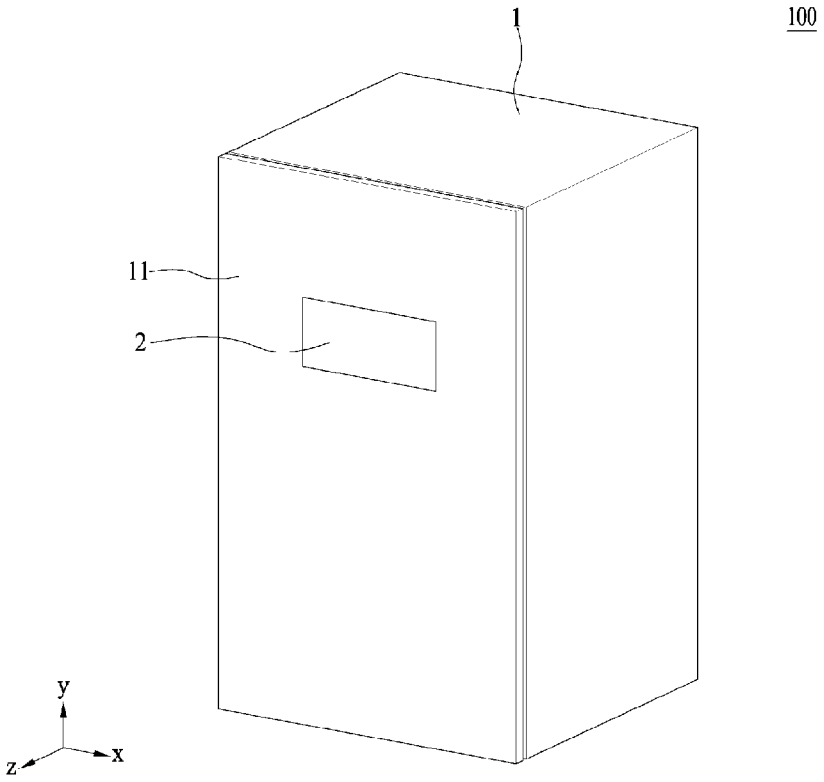
FIG. 1 is a perspective view showing the external appearance of a laundry treating apparatus.

Hereinafter, reference will now be made in detail to the preferred embodiments of the present invention, examples of which are illustrated in the accompanying drawings. Meanwhile, specific structures and functions are described only for a better understanding of the embodiments disclosed herein and are not intended to limit the technical ideas disclosed herein, and it should be understood that the specific structures and functions are intended to encompass all modifications, equivalents, and substitutions included in the spirit and scope of the present invention. In the drawings, the same or similar elements are denoted by the same reference numerals even though they are depicted in different drawings, and a detailed description of the same or similar elements will be omitted.

Figure 2:
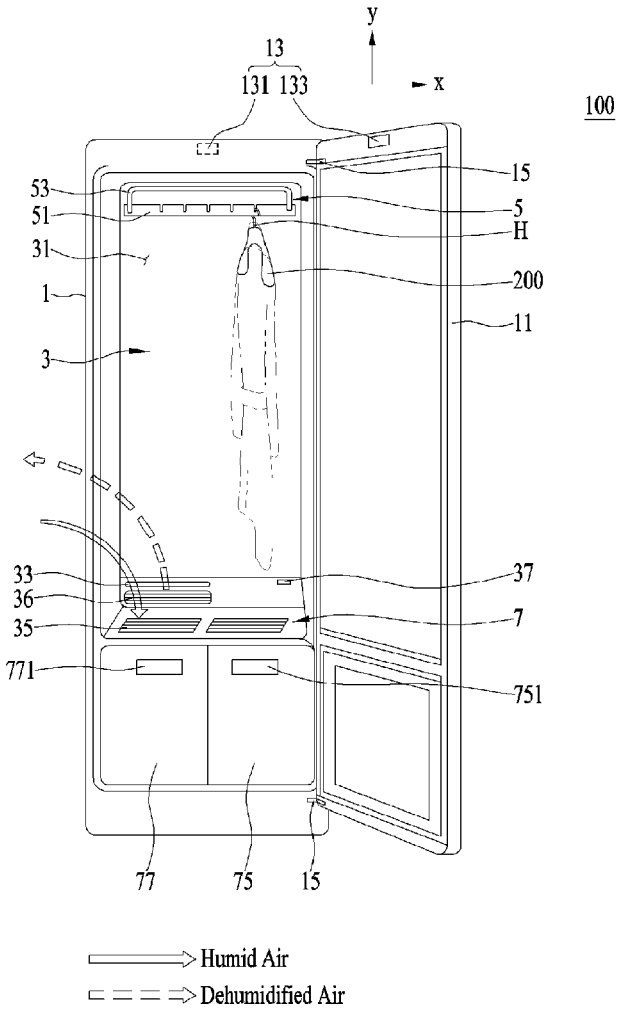
FIGS. 2 and 3 are views showing the interior of the laundry treating apparatus of FIG. 1.
Figure 3:
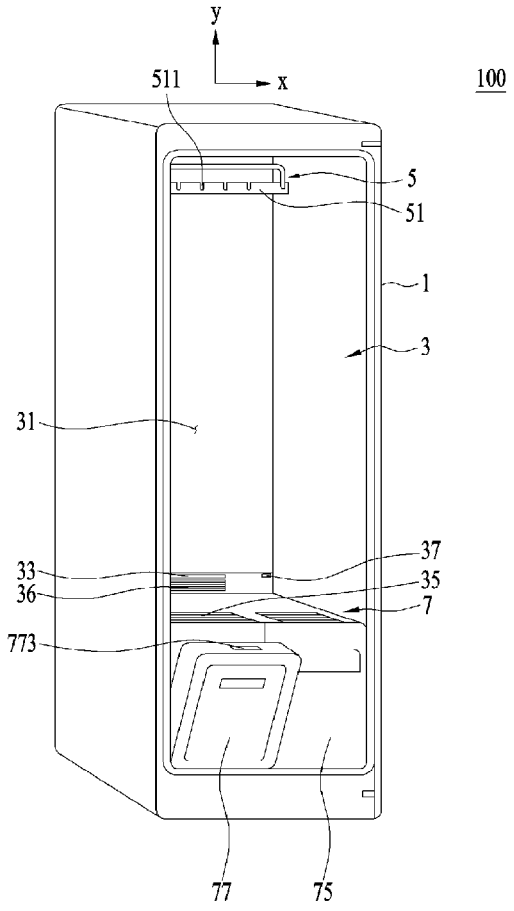
Figure 4:
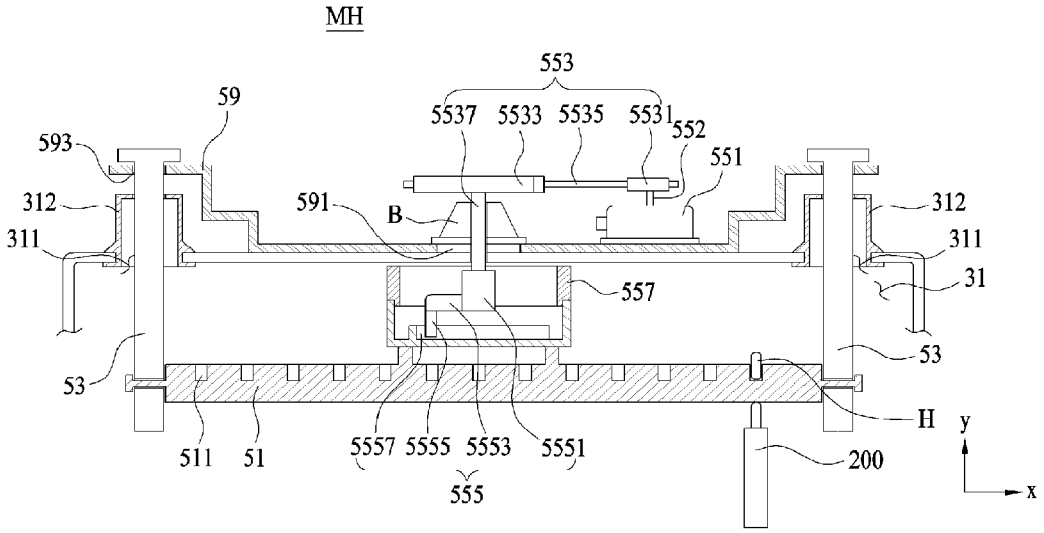
FIGS. 4 to 6 are views showing a moving hanger of FIG. 2.
Figure 5:
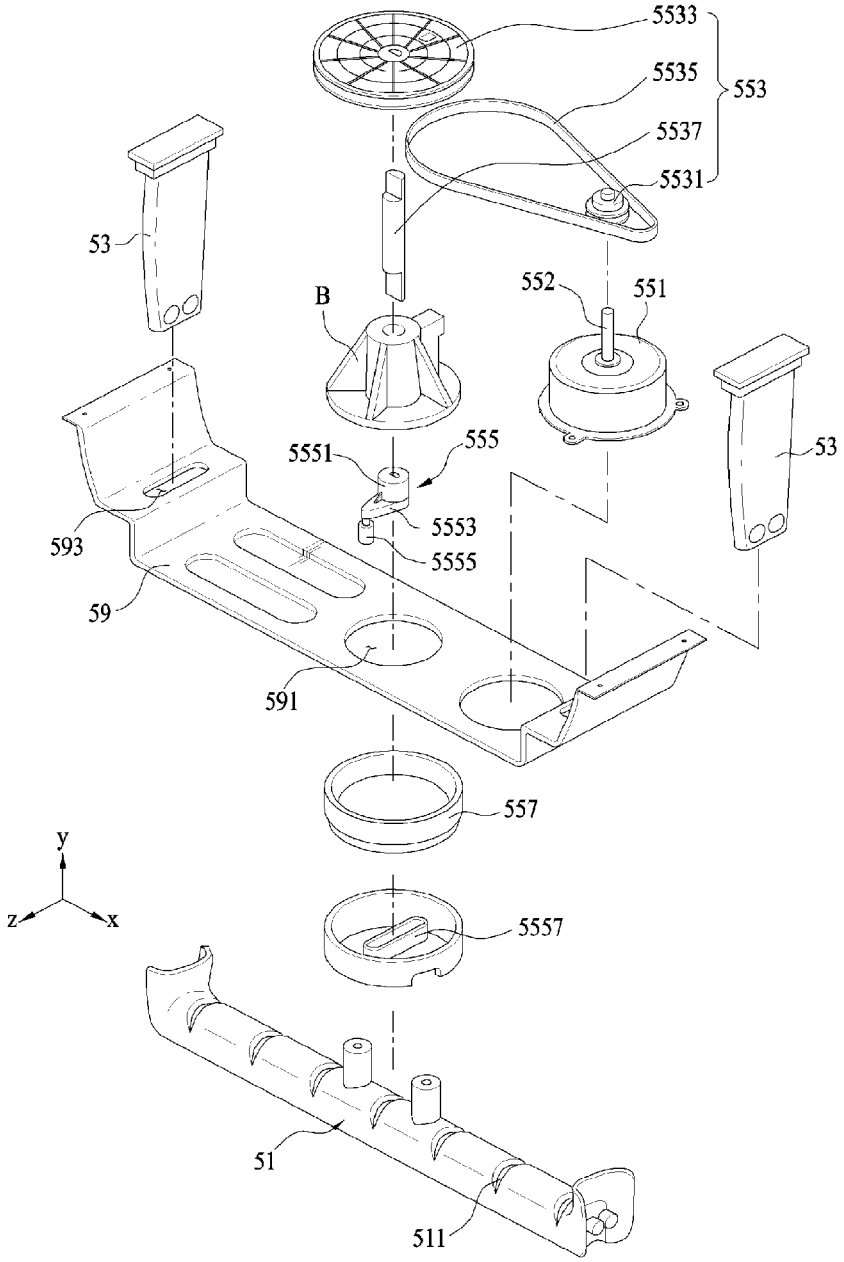
Figure 6:
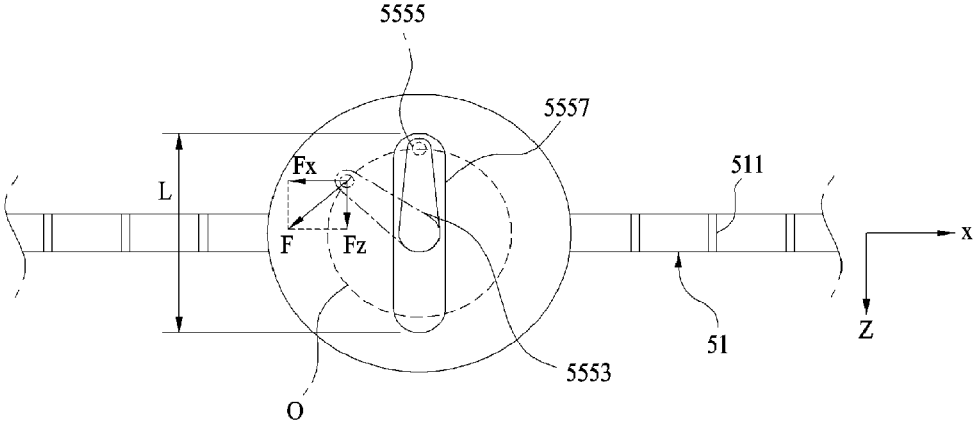

FIG. 1 is a perspective view showing the external appearance of a laundry treating apparatus. FIGS. 2 and 3 are views showing the interior of the laundry treating apparatus of FIG. 1. FIGS. 4 to 6 are views showing a moving hanger of FIG. 2.

The laundry treating apparatus may include an apparatus for drying laundry, deodorizing laundry, and removing wrinkles from laundry, in addition to a refresher for refreshing laundry.

Refreshing may mean a process of providing air, heated air, water, mist, and steam to laundry in order to remove wrinkles from the laundry, to deodorize the laundry, to sanitize the laundry, to prevent static electricity from being generated in the laundry, and to dry the laundry.

The term "laundry" mentioned in this specification includes objects that people can wear, such as shoes, socks, gloves, hats, and mufflers, and objects that people can use, such as dolls, towels, and bedclothes, in addition to clothing and apparel. That is, laundry includes all objects that can be washed.

Referring to FIGS. 1 to 6, the laundry treating apparatus, denoted by reference numeral 100, includes a cabinet 1 configured to define the external appearance thereof, the cabinet 1 having an open surface, a door 11 for opening and closing the open surface of the cabinet 1, a laundry receiving unit 3 provided in the cabinet 1 for receiving laundry, a laundry support unit 5 provided in the cabinet 1 for supporting laundry, and a machinery compartment 7, in which an air supply unit 71 for dehumidifying or heating the air in the laundry receiving unit 3 and a moisture supply unit 73 for supplying moisture to the laundry receiving unit 3 are provided.

Only the air supply unit 71 may be provided in the machinery compartment 7 as needed. However, hereinafter, both the air supply unit 71 and the moisture supply unit 73 will be described as being provided in the machinery compartment 7 for the convenience of description.

The cabinet 1 may be configured to have a structure in which a receiving space 31 is defined in the cabinet 1 while one surface of the cabinet 1 is open. Laundry may be introduced into the receiving space 31 through the open surface of the cabinet 1.

The door 11 may be hingedly connected to the cabinet 1 via a connection member 15 to open and close the open surface of the cabinet 1. For example, the connection member may be a hinge or a link.

In the case in which the laundry treating apparatus 100 dehumidifies indoor air, the door 11 must be maintained open. The connection member 15 may support the door 11 such that the door 11 is maintained at a predetermined opening angle, which will be described later with reference to FIG. 8.

A display panel 2 may be provided on the outer surface of the door 11. The display panel 2 may include a display unit 21 (see FIG. 9) for displaying the operational state of the laundry treating apparatus 100, a manipulation unit 23 (see FIG. 9) for allowing a user to input information for controlling the laundry treating apparatus 100, and an alarm unit (not shown) for providing an alarm message to the user, which will be described later with reference to FIG. 9.

The laundry receiving unit 3 may include a receiving space 31 for receiving laundry, an air suction unit 35 for introducing air from the receiving space 31 into the machinery compartment 7, an air discharge unit 36 for supplying air from the machinery compartment 7 into the receiving space 31, and a moisture discharge unit 37 for supplying moisture from the machinery compartment 7 into the receiving space 31.

The receiving space 31 may be opened and closed by the door 11. When the door 11 is opened, the receiving space 31 may communicate with the interior of a room. The interior of the room means the outside of the laundry treating apparatus 100. The interior of the room may mean the inner space of a room in which the laundry treating apparatus 100 is installed.

The air suction unit 35 and the air discharge unit 36 may be connected to the air supply unit 71 (see FIG. 7) of the machinery compartment 7, and the moisture discharge unit 37 may be connected to the moisture supply unit 73 (see FIG. 7) of the machinery compartment 7, which will be described later with reference to FIG. 7.

Meanwhile, the laundry receiving unit 3 may further include an aroma supply unit 33 for supplying an aromatic material into the receiving space 31. In FIGS. 2 and 3, the aroma supply unit 33 is shown as being provided in the upper surface of the machinery compartment 7. However, the present invention is not limited thereto. The aroma supply unit 33 may be provided at various positions as needed.

In addition, the laundry receiving unit 3 may further include a sterilization unit (not shown) for emitting ultraviolet rays to the laundry received in the receiving space 31 to sterilize the laundry and a deodorization unit (not shown) for deodorizing the laundry received in the receiving space 31.

The laundry support unit 5 may include a moving hanger MH movably provided in the receiving space 31 for moving laundry.

The moving hanger MH may include a hanger bar 51 having receiving recesses 511, in each of which a hook H of a clothes hanger 200 is received, and support bars 53 for supporting opposite ends of the hanger bar 51. The support bars 53 extend through the upper end of the receiving space 31. Each of the support bars 53 may include an elastic material. The opposite ends of the hanger bar 51 are connected to the support bars 53 to support the weight of the clothes hanger 200 and the laundry.

Meanwhile, the moving hanger MH may further include a driving unit 55 for reciprocating the hanger bar 51 in the receiving space 31. The term "reciprocation" means the movement of the hanger bar 51 in the x-z plane as well as the linear reciprocation of the hanger bar 51 along the x axis or the z axis.

In addition, the driving unit 55 may reciprocate the hanger bar 51 along the y axis, although a concrete driving example is not disclosed in this specification.

As shown in FIG. 4, the driving unit 55 may include a motor 551 for generating rotational power, a power conversion unit 555 for converting the rotational power generated by the motor 551 into horizontal reciprocation of the hanger bar 51, a power transmission unit 553 for transmitting the rotational power generated by the motor 551 to the power conversion unit 555, and a support frame 59 provided outside the receiving space 31 for supporting the above-specified elements.

The support frame 59 is provided with support bar fixing holes 593, in which the support bars 53 are fixed. Consequently, one end of each of the support bars 53 is fixed in a corresponding one of the support bar fixing holes 593, and the other end of each of the support bars 53 is located in the receiving space 31 through a corresponding receiving space through-hole 311 provided in the upper surface of the receiving space 31.

Meanwhile, sealing members 312 may be provided in the receiving space through-holes 311 in order to prevent moisture or air, supplied into the receiving space 31, from being discharged out of the receiving space 31 through the receiving space through-holes 311.

As shown in FIG. 5, the power transmission unit 553 may include a driving pulley 5531 coupled to a motor shaft 552, a driven pulley 5533 connected to the driving pulley 5531 via a belt 5535 or a chain, and a shaft 5537 coupled to the center of the driven pulley 5533.

The shaft 5537 may be rotatably supported by a bearing housing B, which is fixed to the support frame 59.

The power conversion unit 555 may include a shaft coupling part 5551 coupled to the shaft 5537, a rotary arm 5553 extending from the shaft coupling part 5551 in the direction perpendicular to the shaft 5537, a slot insertion part 5555 provided at one end of the rotary arm 5553 so as to be rotated about the shaft 5537, and a slot 5557 provided in the hanger bar 51 for receiving the slot insertion part 5555.

In this case, the rotary arm 5553 and the slot insertion part 5555 may be inserted through a conversion unit through-hole 591 provided in the support frame 59, and may be inserted into the slot 5557 provided in the receiving space 31 through the upper surface of the receiving space 31.

Meanwhile, the slot 5557 may be provided in a direction that is parallel to the longitudinal direction of the hanger bar 51. In this case, the hanger bar 51 may reciprocate along the z axis.

Alternatively, as shown in FIG. 6, the slot 5557 may be provided in the direction that is perpendicular to the longitudinal direction of the hanger bar 51. In this case, the hanger bar 51 may reciprocate along the x axis.

In an embodiment, the moving hanger MH may further include a conversion unit cover 557 for preventing the power conversion unit 555 from being exposed outward.

In the moving hanger MH having the above structure, since the driven pulley 5533 is rotated when the motor 551 is rotated, the shaft 5537, which is coupled to the driven pulley 5533, is also rotated. Consequently, the slot insertion part 5555 performs a circular motion about the shaft coupling part 5551 with the length of the rotary arm 5533 as the radius thereof.

As shown in FIG. 6, the slot 5557 provided in the hanger bar 51 may be perpendicular to the longitudinal direction of the hanger bar 51, and the length L of the slot 5557 may be greater than the diameter of a circle that is formed by the rotational orbit O of the slot insertion part 5555.

In this case, the slot 5557 is reciprocated along the x axis even when the slot insertion part 5555 performs a circular motion. Consequently, the hanger bar 51, to which the slot 5557 is fixed, is reciprocated along the x axis in the receiving space.

That is, the slot insertion part 5555 of the power conversion unit 555 performs a circular motion along the rotational orbit O due to the rotational power generated by the motor 551, and the slot 5557 is moved by only a force component Fx of the force F provided by the slot insertion part 5555, which is parallel to the hanger bar 51. Consequently, the hanger bar 51, which is coupled to the slot 5557, is reciprocated along the x axis.

Meanwhile, the length L of the slot 5557 may be less than the diameter of a circle that is formed by the rotational orbit O of the slot insertion part 5555. In this case, the hanger bar 51 is reciprocated in the x-z plane.

In the structure of the moving hanger MH described above, the power generated by the motor 551 is transmitted to the hanger bar 51 through the power transmission unit 553. Alternatively, the power generated by the motor 551 may be directly transmitted to the hanger bar 51. In this case, the shaft coupling part 5551 of the power conversion unit 555 is directly coupled to the motor shaft 552.

Furthermore, the power transmission unit 553 may be configured such that the power generated by the motor 551 is transmitted to the power conversion unit 555 through the driving gear, which is coupled to the motor shaft 552, and the driven gear, to which the shaft 5537 is fixed and which is coupled to the driving gear.

The machinery compartment 7 defines a separate space in the cabinet 1 that is isolated from the receiving space 31. Devices for supplying air, heated air, and moisture into the receiving space 31 may be provided in the machinery compartment 7.

As shown in FIGS. 2 and 3, the machinery compartment 7 is located under the laundry receiving unit 3 to define a separate space that is isolated from the receiving space 31. Devices for supplying air, heated air, and moisture (e.g. water, steam, and mist) into the receiving space 31 may be provided in the machinery compartment 7. In addition, a water supply tank 75 for storing water to be used to generate moisture and a drainage tank 77 for storing condensed water may be provided in the machinery compartment 7.

The water supply tank 75 and the drainage tank 77 may be separably mounted in the machinery compartment 7. A user may separate the water supply tank 75 and the drainage tank 77 from the machinery compartment 7 or may mount the water supply tank 75 and the drainage tank 77 in the machinery compartment 7 using first and second handles 751 and 771. A water supply port 753 (see FIG. 7) and a drainage port 773 may be provided in the upper parts of the water supply tank 75 and the drainage tank 77, respectively.

Hereinafter, the air supply unit 71 and the moisture supply unit 73, which are provided in the machinery compartment 7, will be described in more detail with reference to FIG. 7.

Figure 7:
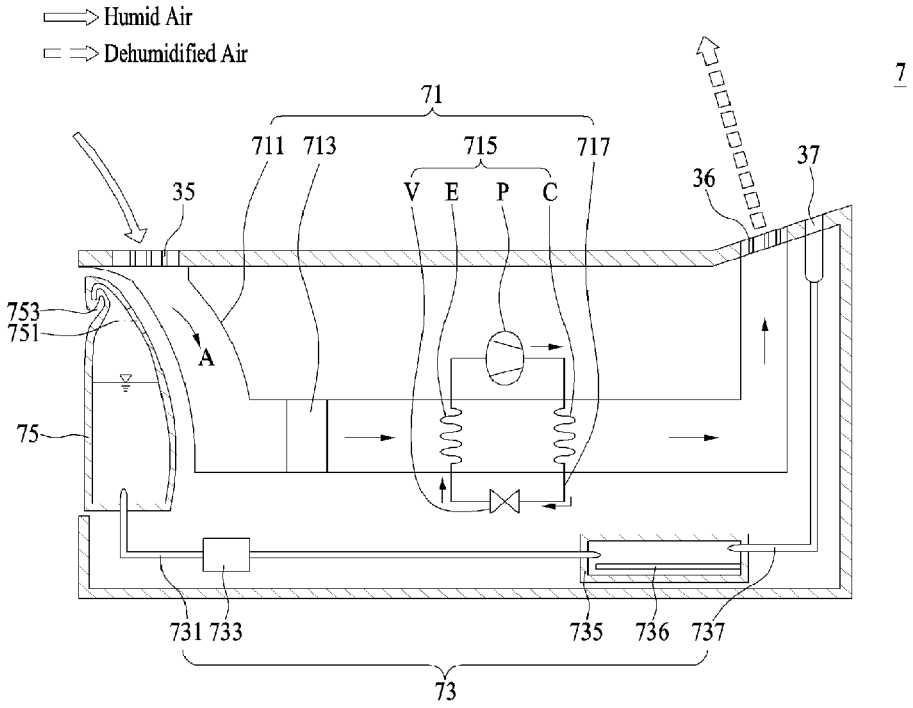
FIG. 7 is a view showing the interior of a machinery compartment.

FIG. 7 is a view showing the interior of the machinery compartment of FIG. 2.

Referring to FIG. 7, the air supply unit 71, configured to dehumidify or heat the air in the receiving space 31, and the moisture supply unit 73, configured to supply moisture into the receiving space 31, may be provided in the machinery compartment 7.

In addition, the air suction unit 35, the air discharge unit 36, and the moisture discharge unit 37, through which the receiving space 31 and the interior of the machinery compartment 7 communicate with each other, may be provided in the upper surface of the machinery compartment 7. The air suction unit 35 and the air discharge unit 36 may be connected to the air supply unit 71, and the moisture discharge unit 37 may be connected to the moisture supply unit 73.

In this case, in the state in which the door 11 is closed, the air in the receiving space 31 may be supplied to the air supply unit 71 through the air suction unit 35, and the air dehumidified and heated in the air supply unit 71 may be resupplied into the receiving space 31 through the air discharge unit 36.

In the state in which the door 11 is open, on the other hand, the air in the receiving space 31 and the air in the room communicating with the receiving space 31 may be supplied to the air supply unit 71 through the air suction unit 35, and the air dehumidified in the air supply unit 71 may be resupplied into the room through the air discharge unit 36.

Meanwhile, as shown in FIGS. 2 and 3, the air suction unit 35 may be provided in the front of the upper surface of the machinery compartment 7, i.e. the portion of the machinery compartment 7 that is adjacent to the door 11. In this case, the air in the room may be more easily introduced into the air suction unit 35, thereby improving the dehumidification efficiency of the laundry treating apparatus 100.

In addition, the air discharge unit 36 and the moisture discharge unit 37 may be provided in the rear of the upper surface of the machinery compartment 7, i.e. the portion of the machinery compartment 7 that is adjacent to the rear wall of the cabinet 1. In this case, air or moisture discharged from the machinery compartment 7 may be prevented from condensing on the surface of the door 11.

However, the positions and sizes of the air suction unit 35, the air discharge unit 36, and the moisture discharge unit 37 are not limited to what is shown in FIGS. 2 and 3. The positions and sizes of the air suction unit 35, the air discharge unit 36, and the moisture discharge unit 37 may be variously changed as needed.

The moisture supply unit 73 may be provided in the machinery compartment 7 to supply water, steam, or mist into the receiving space 31. Hereinafter, the moisture supply unit 73 will be described as supplying steam.

The moisture supply unit 73 may include a moisture supply pipe 731 connected to a water supply tank 75, a pump 733 provided at the moisture supply pipe 731, a steam generator 735 for generating steam from the water supplied through the moisture supply pipe 73, and a steam supply pipe 737 for guiding the generated steam to the moisture discharge unit 37. A heater 734 may be mounted in the steam generator 735 to heat water.

The air supply unit 71 may include a circulation duct 711 configured to define an air circulation channel, a blower 713 provided in the circulation duct 711 for circulating air, and a heat exchanger 715 for dehumidifying or heating the air in the circulation duct 711.

One end of the circulation duct 711 may be connected to the air suction unit 35, and the other end of the circulation duct 711 may be connected to the air discharge unit 36. Consequently, the air introduced into the circulation duct 711 through the air suction unit 35 may be dehumidified or heated while passing through the heat exchanger 715, and may then be discharged into the receiving space 31 through the air discharge unit 36.

The blower 713 may be provided between the air suction unit 35 and the heat exchanger 715 to generate positive pressure between the air suction unit 35 and the heat exchanger 715 such that air can flow toward the heat exchanger 715.

Alternatively, the blower 713 may be provided between the heat exchanger 715 and the air discharge unit 36. In this case, the blower 713 may generate negative pressure at the rear of the heat exchanger 715 such that the air in the circulation duct 711 can be circulated.

The heat exchanger 715 may circulate a refrigerant to constitute a refrigerating cycle. The heat exchanger 715 may exchange heat with the air in the circulation duct 711 to remove moisture from the air or to heat the air. For example, in the case in which the heat exchanger 715 is configured as a heat pump, the heat exchanger 715 may include an expansion valve V, an evaporator E, a compressor P, a condenser C, and a refrigerant pipe 716 for connecting the above-specified elements to each other.

The expansion valve V may be provided outside the circulation duct 711 to decompress the refrigerant to a pressure at which the refrigerant can evaporate and to supply the decompressed refrigerant to the evaporator E.

In an embodiment, the expansion valve V may be an electronic linear expansion valve LEV. The opening degree of the electronic linear expansion valve may be controlled using a pulse signal to adjust the flow rate, temperature, and pressure of the refrigerant to be supplied to the evaporator E. For example, when the opening degree of the expansion valve V is increased, the flow rate and temperature of the refrigerant to be supplied to the evaporator E may be increased. On the other hand, when the opening degree of the expansion valve V is decreased, the flow rate and temperature of the refrigerant to be supplied to the evaporator E may be decreased.

The evaporator E may be provided in the circulation duct 711 to absorb heat from the air in the circulation duct 711 such that the refrigerant is evaporated. As a result, the moisture in the air may be removed in the form of condensed water. The condensed moisture may be received in the drainage tank 77 through a condensed water collection unit (not shown).

The compressor P may be provided outside the circulation duct 711 to compress the refrigerant and to supply the compressed refrigerant to the condenser C.

In an embodiment, the compressor P may be an inverter type compressor. The inverter type compressor may convert DC voltage into AC voltage of a desired frequency and supply the converted AC voltage to a motor of the compressor to control the rotational speed of the compressor motor. Hereinafter, the converted AC frequency value will be defined as a driving frequency of the compressor. When the driving frequency is increased, a larger amount of refrigerant may be compressed, but the rotational speed of the compressor motor is increased, with the result that noise may be increased. On the other hand, when the driving frequency is decreased, noise may be decreased, but the compression ratio of the refrigerant may be decreased. In this case, the air heating capacity of the condenser C, a description of which will follow, may also be decreased.

The condenser C may be provided in the circulation duct 711 at the rear of the evaporator E to supply heat to the air in the circulation duct such that the refrigerant is condensed. As a result, the air may be heated and supplied into the receiving space 31.

Meanwhile, the temperature of the air that is discharged through the air discharge unit 36 via the condenser C in the state in which the door 11 is open may be lower than that of the air that is discharged through the air discharge unit 36 via the condenser C in the state in which the door 11 is closed.

This may be achieved by controlling the driving frequency of the compressor P. For example, when the compressor P is driven at a first driving frequency in the state in which the door 11 is closed and when the compressor P is driven at a second driving frequency, which is lower than the first driving frequency, in the state in which the door 11 is open, it is possible to decrease the temperature of the air that is discharged through the air discharge unit 36 via the condenser C. In the case in which the door 11 is open and the air in the room is dehumidified, therefore, it is possible to prevent the air in the room from being heated. In addition, the driving frequency of the compressor P may be also decreased, whereby the noise generated from the compressor motor may be decreased.

As described above, the heat exchanger 715 may be differently controlled depending on the operation mode of the laundry treating apparatus 100.

In the case in which the door 11 is closed, i.e. in the case in which the laundry in the receiving space 31 is refreshed, the air in the receiving space 31 may be dehumidified, and heated air may be supplied into the receiving space 31. Of course, unheated air, rather than heated air, may be supplied into the receiving space 31 as needed.

On the other hand, in the case in which the door 11 is open, i.e. in the case in which the air in the room is dehumidified, air having a lower temperature than in the case in which the laundry is refreshed may be discharged into the room. In addition, the noise generated from the compressor P may be decreased.

Hereinafter, the dehumidification capacity of the laundry treating apparatus 100 depending on the opening degree of the door 11 will be described in more detail with reference to FIG. 8.

Figure 8:
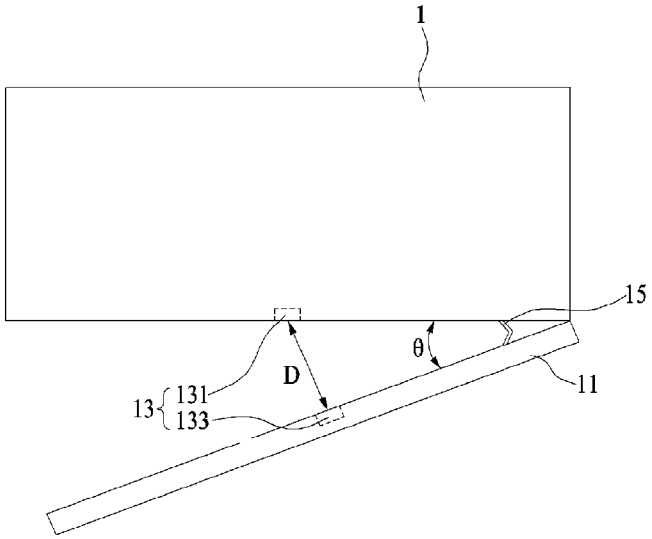
FIG. 8 is a plan view showing the laundry treating apparatus of FIG. 1.

FIG. 8 is a plan view showing the laundry treating apparatus of FIG. 1.

Referring to FIG. 8, the door 11 may be hingedly connected to the cabinet 1 via the connection member 15 to selectively open and close the receiving space 31. Whether the door 11 is open or closed and the opening angle θ of the door 11 may be sensed by an opening and closing sensing unit 13.

In an embodiment, the opening and closing sensing unit 13 may include a reed switch 131 mounted in the cabinet 1 and a permanent magnet 133 mounted in the door 11. The reed switch 131 may be a switch configured such that the contact portion of the switch is encapsulated in a glass tube filled with an inert gas. The contact portion of the reed switch 131 may be turned on or off when the permanent magnet 133 approaches the reed switch 131. That is, the distance D between the cabinet 1 and the door 11 may be increased as the opening angle of the door is increased. The opening and closing sensing unit 13 may sense the opening angle θ of the door 11 depending on the distance D between the cabinet 1 and the door 11.

Table 1 shows the amount of dehumidification depending on the opening angle θ of the door 11.

TABLE 1

| Opening angle of door (degrees) | Amount of dehumidification (L/h) |
|---|---|
| 15 | 0.369 |
| 30 | 0.393 |
| 45 | 0.400 |
| 60 | 0.416 |
| 90 | 0.435 |

It can be seen from Table 1 that, as the opening angle θ of the door 11 is increased, the amount of dehumidification is increased and that, when the opening angle θ of the door 11 is the maximum (90 degrees), the amount of dehumidification is also the maximum. However, even in the case in which the door 11 is almost closed, e.g. even in the case in which the door 11 is open 15 degrees, it is possible to achieve dehumidification performance equivalent to about 85% of the dehumidification performance in the case in which the door 11 is completely open.

Meanwhile, as the opening angle θ of the door 11 is increased, noise generated in the machinery compartment 7 may be more easily transmitted into the room. Consequently, it is necessary to control the opening angle θ of the door 11 in appropriate consideration of the amount of dehumidification and the noise. At this time, the connection member 15 may support the door 11 such that a predetermined opening angle θ of the door 11 is maintained.

Figure 9:
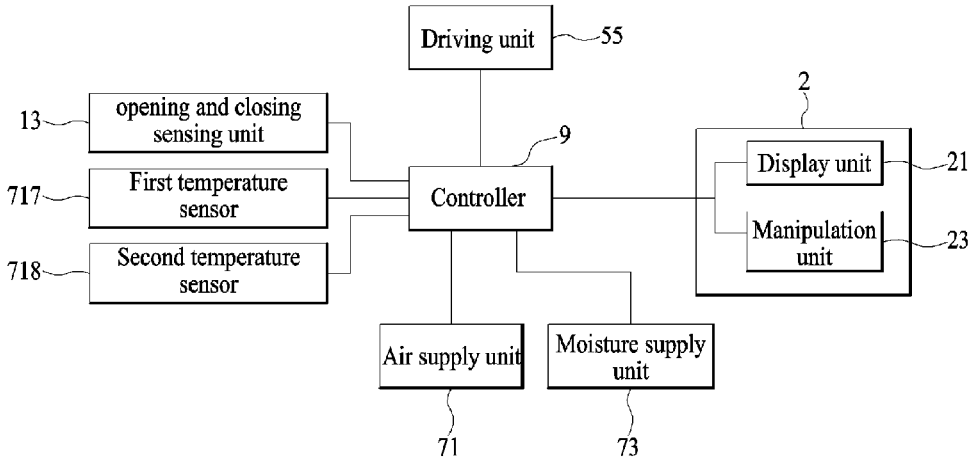
FIG. 9 is a block diagram showing a control system of the laundry treating apparatus of FIG. 1.

FIG. 9 is a block diagram showing a control system of the laundry treating apparatus 100 of FIG. 1.

Referring to FIG. 9, the control system of the laundry treating apparatus 100 includes an opening and closing sensing unit 13 for sensing whether the door 11 is open or closed, a first temperature sensor 717 for measuring the temperature Tr of the refrigerant that is supplied to the evaporator E, a second temperature sensor 718 for measuring the temperature Ta of the air that is discharged into the receiving space 31 through the air discharge unit 36, a driving unit 55 for driving the moving hanger MH, an air supply unit 71 for dehumidifying or heating the air in the receiving space 31, a moisture supply unit 73 for supplying moisture into the receiving space 31, a display panel 2 for displaying the operational state of the laundry treating apparatus 100 and allowing a user to input information for controlling the laundry treating apparatus 100, and a controller 9 for controlling the operation of the laundry treating apparatus 100.

The opening and closing sensing unit 13 may sense the opening angle θ of the door 11 and may provide information about the sensed opening angle θ of the door 11 to the controller 9.

The first temperature sensor 717 may be mounted in the refrigerant pipe 716 in front of the evaporator E to measure the temperature Tr of the refrigerant that is supplied to the evaporator E. The second temperature sensor 718 may be mounted in the rear end of the circulation duct 711 to measure the temperature Ta of the air that is discharged through the air discharge unit 36. Information about the temperatures detected by the first and second temperature sensors 717 and 718 may be provided to the controller 9.

The display panel 2 may include a display unit 21 for displaying the operational state of the laundry treating apparatus 100 and a manipulation unit 23 for allowing a user to input information for controlling the laundry treating apparatus 100. The user may select whether to operate the laundry treating apparatus 100, the operation time of the laundry treating apparatus 100, and the operation mode of the laundry treating apparatus 100 using the manipulation unit 23. For example, the operation mode may include a drying mode in which the laundry in the receiving space 31 is refreshed in the state in which the door 11 is closed and a dehumidification mode in which the air in the room is dehumidified in the state in which the door 11 is open. Selected control information may be provided to the controller 9.

The controller 9 may receive information about whether the door 11 is open or closed and the opening angle θ of the door 11 from the opening and closing sensing unit 13, may receive information about the temperature Tr of the refrigerant that is supplied to the evaporator E from the first temperature sensor 717, may receive information about the temperature Ta of the air that is discharged through the air discharge unit 36 from the second temperature sensor 718, and may receive the information for controlling the laundry treating apparatus 100 from the manipulation unit 23.

The controller 9 may control the operation of the driving unit 55, the air supply unit 71, and the moisture supply unit 73 using the received information. In addition, the controller 9 may provide information about the operation and state of the laundry treating apparatus 100 to the display unit 21. The display unit 21 may display the received information such that the user can recognize the information.

Although not shown, an alarm unit for informing the user of a problem that occurs during the operation of the laundry treating apparatus 100, if any, may be further provided. For example, in the case in which the user selects the dehumidification mode but the door 11 is not open, the alarm unit may inform the user of the same. The alarm unit may be included in the display unit 21. Alternatively, the alarm unit may be separately provided as a buzzer.

Hereinafter, a method of controlling the laundry treating apparatus 100 using the control system of FIG. 9 will be described in more detail. The user may select the drying mode or the dehumidification mode through the manipulation unit 23.

Figure 10:
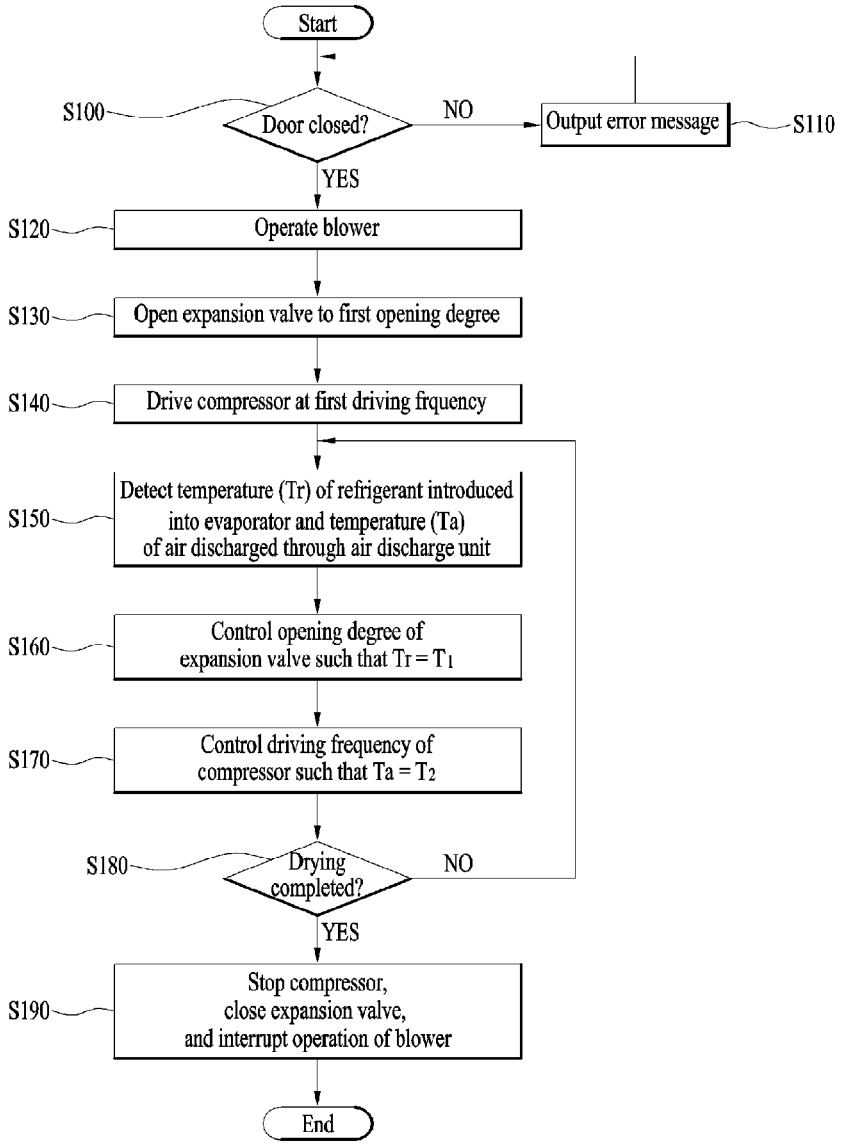
FIG. 10 is a flowchart showing a method of controlling the laundry treating apparatus using the control system of FIG. 9 when a drying mode is selected.

FIG. 10 is a flowchart showing a method of controlling the laundry treating apparatus using the control system of FIG. 9 when the drying mode is selected.

Referring to FIG. 10, it is determined whether the door 11 is closed (S100).

The drying mode must be executed in the state in which the door 11 is closed, since the drying mode is a mode in which the laundry received in the laundry treating apparatus 100 is refreshed. In the case in which the door 11 is not closed, therefore, an error message is output through the alarm unit (S110). Whether the door 11 is closed may be sensed by the opening and closing sensing unit 13.

Upon determining that the door 11 is closed, the heat exchanger 715 is operated (S120, S130, and S140).

Specifically, the blower 713 is operated, the expansion valve V is opened to a first predetermined opening degree, and the compressor P is driven at a first predetermined driving frequency. The first opening degree and the first driving frequency may be changed depending on the performance of the laundry treating apparatus and the operation time of the laundry treating apparatus that is selected by the user. For example, the first driving frequency may be about 75 Hz.

According to the operation of the heat exchanger 715, the air in the receiving space 31 may be introduced into the air supply unit 71 through the air suction unit 35. The introduced air may be dehumidified and heated while passing through the air supply unit 71, and may return into the receiving space 31 through the air discharge unit 36. In addition, the moisture supply unit 73 may be operated to supply moisture into the receiving space 31 as needed.

In this case, the opening degree of the expansion valve V and the driving frequency of the compressor P are adjusted based on information about the temperature Tr of the refrigerant that is introduced into the evaporator E and information about the temperature Ta of the air that is discharged into the receiving space 31 through the air discharge unit 36 (S150, S160, and S170).

Specifically, the temperature Tr of the refrigerant that is supplied to the evaporator E is detected using the first temperature sensor 717 mounted in the refrigerant pipe 716 in front of the evaporator E, and the temperature Ta of the air that is discharged through the air discharge unit 36 is detected using the second temperature sensor 718 mounted in the rear end of the circulation duct 711. Information about the detected temperatures is transmitted to the controller 9.

The controller 9 may determine whether the heat exchanger 715 is operating in a predetermined state based on the received temperature information. In the case in which the received temperatures are not different from predetermined values, the opening degree of the expansion valve V and the driving frequency of the compressor P are adjusted.

For example, in the case in which the temperature Tr of the refrigerant that is supplied to the evaporator E is higher than a first predetermined temperature $T_1$, the controller 9 may perform control such that the opening degree of the expansion valve V is decreased to a predetermined level. As the opening degree of the expansion valve V is decreased, the flow rate and temperature of the refrigerant that is supplied to the evaporator E may also be decreased. On the other hand, in the case in which the temperature Tr of the refrigerant that is supplied to the evaporator E is lower than the first temperature $T_1$, the controller 9 may perform control such that the opening degree of the expansion valve V is increased to increase the flow rate and temperature of the refrigerant that is supplied to the evaporator E. The first temperature $T_1$ may be, for example, about 17° C.

In addition, in the case in which the temperature Ta of the air that is discharged through the air discharge unit 36 is higher than a second predetermined temperature $T_2$, the controller 9 may perform control such that the driving frequency of the compressor P is decreased to a predetermined level. As the driving frequency of the compressor P is decreased, the compression ratio of the refrigerant may be decreased, whereby the amount of heat that the refrigerant can transfer to the air in the condenser C may be decreased. As a result, the temperature Ta of the air that is discharged through the air discharge unit 36 may be decreased. On the other hand, in the case in which the temperature Ta of the air that is discharged through the air discharge unit 36 is lower than the second temperature $T_2$, the controller 9 may perform control such that the driving frequency of the compressor P is increased to increase the temperature Ta of the air that is discharged through the air discharge unit 36. The second temperature $T_2$ may be, for example, about 61° C.

As described above, the controller 9 may perform control such that the opening degree of the expansion valve V and the driving frequency of the compressor P are adjusted to operate the heat exchanger 715 in the predetermined state.

When drying has been completed (S180), the compressor P is stopped, the expansion valve V is closed, and the operation of the blower 713 is interrupted (S190). In this case, whether drying has been completed may be determined based on the temperature and humidity in the receiving space 31 or based on whether a predetermined operation time has elapsed.

As described above, the laundry treating apparatus 100 according to the present invention is capable of dehumidifying and heating the air in the receiving space 31 and resupplying the dehumidified and heated air into the receiving space 31. At this time, the operational characteristics of the heat exchanger 715 may be controlled to adjust the amount of air that is dehumidified and heated.

Figure 11:
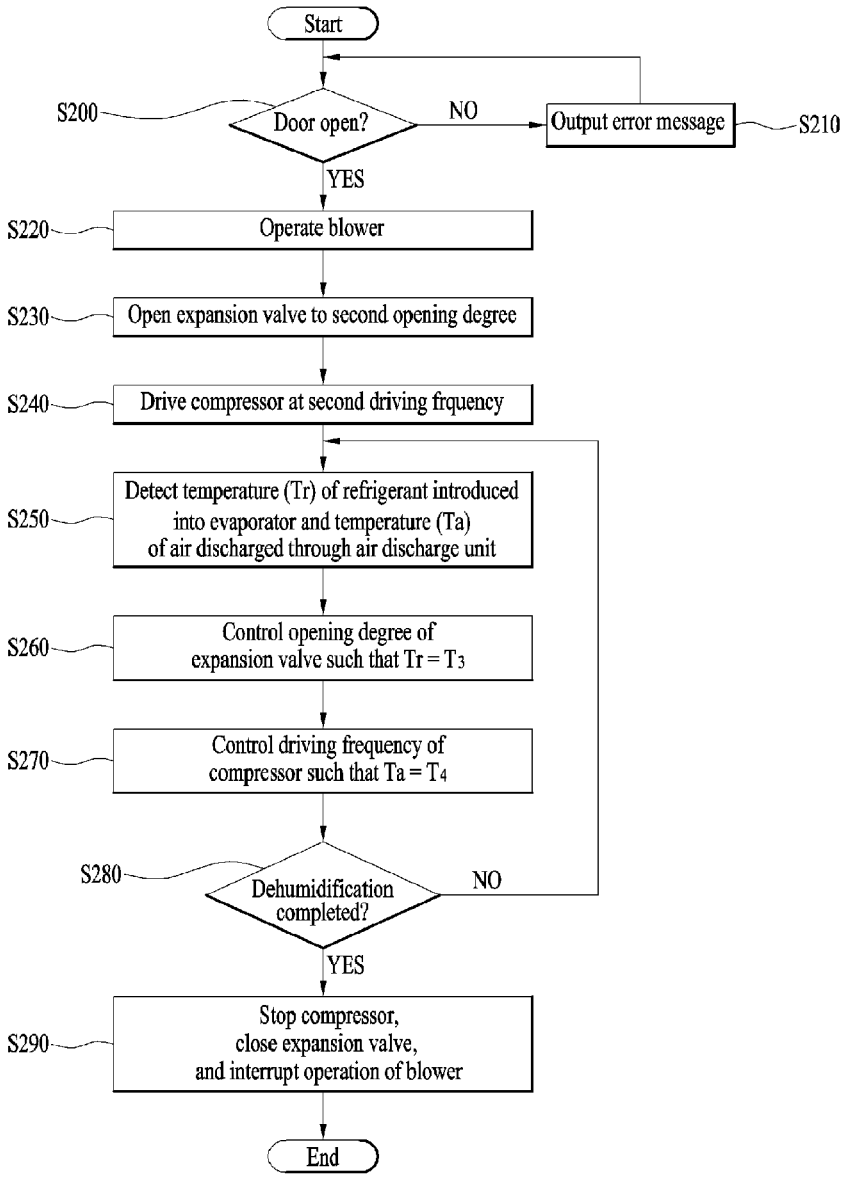
FIG. 11 is a flowchart showing a method of controlling the laundry treating apparatus using the control system of FIG. 9 when a dehumidification mode is selected.

FIG. 11 is a flowchart showing a method of controlling the laundry treating apparatus using the control system of FIG. 9 when the dehumidification mode is selected.

The dehumidification mode must be executed in the state in which the door 11 is open, since the dehumidification mode is a mode in which moisture is removed from the air in the room. In the case in which the door 11 is not open, therefore, an error message is output through the alarm unit (S210). Whether the door 11 is open may be sensed by the opening and closing sensing unit 13.

Upon determining that the door 11 is open, the heat exchanger 715 is operated (S220, S230, and S240).

Specifically, the blower 713 is operated, the expansion valve V is opened to a second predetermined opening degree, and the compressor P is driven at a second predetermined driving frequency. The second opening degree and the second driving frequency may be changed depending on the performance of the laundry treating apparatus and the operation time of the laundry treating apparatus, which is selected by the user.

Meanwhile, the second opening degree may be lower than the first opening degree in the drying mode, and the second driving frequency may be lower than the first driving frequency in the drying mode. The reasons for this are that it is necessary to prevent an increase in the temperature Ta of the air that is discharged into the room through the air discharge unit 36 and to decrease noise generated from the heat exchanger 715. For example, the second driving frequency may be about 47 Hz.

According to the operation of the heat exchanger 715, the air in the room may be introduced into the air supply unit 71 through the air suction unit 35. The introduced air may be dehumidified while passing through the air supply unit 71, and may return into the room through the air discharge unit 36. Meanwhile, the air that returns into the room may be heated relatively less, since the opening degree of the expansion valve V and the driving frequency of the compressor P in the dehumidification mode are lower than the opening degree of the expansion valve V and the driving frequency of the compressor P in the drying mode. Consequently, an increase in the temperature in the room may be prevented.

In this case, the opening degree of the expansion valve V and the driving frequency of the compressor P are adjusted based on information about the temperature Tr of the refrigerant that is introduced into the evaporator E and information about the temperature Ta of the air that is discharged into the room through the air discharge unit 36 (S250, S260, and S270).

Specifically, the temperature Tr of the refrigerant that is supplied to the evaporator E is detected using the first temperature sensor 717 mounted in the refrigerant pipe 716 in front of the evaporator E, and the temperature Ta of the air that is discharged through the air discharge unit 36 is detected using the second temperature sensor 718 mounted in the rear end of the circulation duct 711. Information about the detected temperatures is transmitted to the controller 9.

The controller 9 may determine whether the heat exchanger 715 is operating in a predetermined state based on the received temperature information. In the case in which the received temperatures are not different from predetermined values, the opening degree of the expansion valve V and the driving frequency of the compressor P are adjusted.

For example, in the case in which the temperature Tr of the refrigerant that is supplied to the evaporator E is higher than a third predetermined temperature $T_3$, the controller 9 may perform control such that the opening degree of the expansion valve V is decreased to a predetermined level. As the opening degree of the expansion valve V is decreased, the flow rate and temperature of the refrigerant that is supplied to the evaporator E may also be decreased. On the other hand, in the case in which the temperature Tr of the refrigerant that is supplied to the evaporator E is lower than the third temperature $T_3$, the controller 9 may perform control such that the opening degree of the expansion valve V is increased to increase the flow rate and temperature of the refrigerant that is supplied to the evaporator E. The third temperature $T_3$ may be, for example, about 8° C.

In addition, in the case in which the temperature Ta of the air that is discharged through the air discharge unit 36 is higher than a fourth predetermined temperature $T_4$, the controller 9 may perform control such that the driving frequency of the compressor P is decreased to a predetermined level. As the driving frequency of the compressor P is decreased, the compression ratio of the refrigerant may be decreased, whereby the amount of heat that the refrigerant can transfer to the air in the condenser C may be decreased. As a result, the temperature Ta of the air that is discharged through the air discharge unit 36 may be decreased. On the other hand, in the case in which the temperature Ta of the air that is discharged through the air discharge unit 36 is lower than the fourth temperature $T_4$, the controller 9 may perform control such that the driving frequency of the compressor P is increased to increase the temperature Ta of the air that is discharged through the air discharge unit 36. The fourth temperature $T_4$ may be, for example, about 45° C.

As described above, the controller 9 may perform control such that the opening degree of the expansion valve V and the driving frequency of the compressor P are adjusted to operate the heat exchanger 715 in the predetermined state.

When dehumidification has been completed (S280), the compressor P is stopped, the expansion valve V is closed, and the operation of the blower 713 is interrupted (S290). In this case, whether dehumidification has been completed may be determined based on the temperature and humidity in the room or based on whether the predetermined operation time has elapsed.

As described above, the laundry treating apparatus 100 according to the present invention is capable of dehumidifying indoor air in the state in which the door 11 is open. At this time, the operational characteristics of the heat exchanger 715 may be controlled to adjust the amount of indoor air that is dehumidified.

As is apparent from the above description, the laundry treating apparatus according to the present invention is capable of easily drying, deodorizing, and sterilizing laundry and easily removing wrinkles from the laundry.

In addition, the laundry treating apparatus according to the present invention is capable of dehumidifying indoor air in the state in which the door is open.

In addition, the laundry treating apparatus according to the present invention is capable of maximally preventing an increase in the temperature of indoor air when dehumidifying the indoor air.

Effects of the present invention are not limited to the above-mentioned effects, and may be variously extended without departing from the spirit or scope of the present invention.

Although the exemplary embodiments have been illustrated and described as above, of course, it will be apparent to those skilled in the art that the embodiments are provided to assist understanding of the present invention and the present invention is not limited to the above described particular embodiments, and various modifications and variations can be made in the present invention without departing from the spirit or scope of the present invention, and the modifications and variations should not be understood individually from the viewpoint or scope of the present invention.

What is claimed is:

1. A laundry treating apparatus comprising:

a cabinet that includes an opening at a front side of the cabinet;

a door hingedly provided at the cabinet for opening and closing the opening;

a first chamber located inside the cabinet for receiving laundry;

a second chamber located below the first chamber inside the cabinet;

an air supply unit located inside the second chamber and configured to dehumidify or heat air in the first chamber, and supply the dehumidified or heated air into the first chamber; and an opening and closing sensing unit for sensing whether the door is open or closed;

wherein a temperature of the air supplied by the air supply unit when the door opens is different from a temperature of the air supplied by the air supply unit when the door closes.

2. The laundry treating apparatus according to claim 1, wherein the temperature of the supplied air is lower when the door is open than when the door is closed.

3. The laundry treating apparatus according to claim 1, wherein the air supply unit comprises:

a circulation duct located in the second chamber for circulating the air in the first chamber; and a heat exchanger configured to circulate a refrigerant so as to constitute a refrigerating cycle, the heat exchanger being configured to dehumidify or heat the circulated air along the circulation duct through heat exchange.

4. The laundry treating apparatus according to claim 3, wherein the heat exchanger comprises:

an evaporator located in the circulation duct for dehumidifying the air introduced into the circulation duct;

a condenser located in the circulation duct for heating the air that has passed through the evaporator; and a compressor located outside the circulation duct for circulating the refrigerant through the evaporator and the condenser.

5. The laundry treating apparatus according to claim 4, wherein a driving frequency for the compressor during operation of the compressor varies based on the door's opening or closing via the opening and closing sensing unit.

6. The laundry treating apparatus according to claim 5, wherein the driving frequency is lower when the door is open than when the door is closed.

7. The laundry treating apparatus according to claim 4, wherein the compressor is an inverter type compressor that converts DC voltage into AC voltage to rotate a motor of the compressor.

8. The laundry treating apparatus according to claim 4, further comprising:

a connection member configured to connect the door and the cabinet to each other such that the door selectively opens the first chamber or the door closes the first chamber, wherein the connection member supports the door such that the door is maintained with a predetermined opening angle.

9. The laundry treating apparatus according to claim 8, wherein the opening and closing sensing unit further senses the predetermined opening angle, and a controller in the cabinet detects whether the door is open with the predetermined angle or closed via the opening and closing sensing unit, and adjusts a driving frequency for the compressor.

10. The laundry treating apparatus according to claim 9, wherein the controller decreases the driving frequency for the compressor based on that the predetermined opening angle is increased.

11. The laundry treating apparatus according to claim 4, wherein the heat exchanger further comprises:

an expansion valve located between the condenser and the evaporator inside the circulation duct and configured to decrease a temperature of the refrigerant passing through the condenser.

12. The laundry treating apparatus according to claim 11, wherein the expansion valve is an electronic linear expansion valve (LEV) that is configured to adjust an opening degree of the electronic LEV to change the flow rate of the refrigerant, based on the door's opening or closing via the opening and closing sensing unit.

13. The laundry treating apparatus according to claim 12, wherein the opening and closing sensing unit further senses the predetermined opening angle, and a controller in the cabinet detects whether the door is open with the predetermined angle or closed via the opening and closing sensing unit, and adjusts the opening degree of the expansion valve.

14. The laundry treating apparatus according to claim 13, wherein the controller decreases the opening degree of the expansion valve based on that the predetermined opening angle is increased.

15. The laundry treating apparatus according to claim 1, wherein the opening and closing sensing unit comprises:

a magnet located in one of the door or the cabinet; and a reed switch located in the other one of the door or the cabinet and configured to detect the magnet.

16. The laundry treating apparatus according to claim 1, further comprising:

a moisture supply unit for supplying moisture into the first chamber.

17. The laundry treating apparatus according to claim 16, further comprising:

a controller receiving information about whether the door is open or closed from the opening and closing sensing unit and controlling an operation of the air supply unit and the moisture supply unit, wherein the controller operates the moisture supply unit when the door is closed.

18. The laundry treating apparatus according to claim 1, further comprising an air suction unit located closer to the door than a rear side of the first chamber at a bottom of the first chamber for moving the air in the first chamber into the air supply unit.

19. The laundry treating apparatus according to claim 1, further comprising:

a laundry support unit provided in the first chamber for supporting laundry.

20. The laundry treating apparatus according to claim 19, wherein the laundry support unit comprises:

a hanger bar located in an upper portion inside the first chamber;

a driving unit configuring for reciprocating the hanger bar along a width direction of the cabinet; and a controller receiving information about whether the door is open or closed from the opening and closing sensing unit and controlling an operation of the driving unit, wherein the controlled operates the driving unit based on the door's opening or closing via the opening and closing sensing unit.

* * * * *